US010108112B2

(12) United States Patent
Miyazaki

(10) Patent No.: US 10,108,112 B2
(45) Date of Patent: Oct. 23, 2018

(54) IMAGE FORMING APPARATUS THAT ADJUSTS IMAGE FORMATION TIMING BASED ON IMAGE TRANSFER POSITION

(71) Applicant: Oki Data Corporation, Tokyo (JP)

(72) Inventor: Yoshitaka Miyazaki, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/410,638

(22) Filed: Jan. 19, 2017

(65) Prior Publication Data

US 2017/0227893 A1 Aug. 10, 2017

(30) Foreign Application Priority Data

Feb. 5, 2016 (JP) ..... 2016-020834

(51) Int. Cl.
*G03G 15/16* (2006.01)

(52) U.S. Cl.
CPC ..... *G03G 15/1605* (2013.01)

(58) Field of Classification Search
None
See application file for complete search history.

(56) References Cited

U.S. PATENT DOCUMENTS 5,991,563 A * 11/1999 Haneda ..... G03G 15/231 399/309
2010/0329719 A1* 12/2010 Hashiguchi ..... G03G 15/50 399/68
2015/0023675 A1* 1/2015 Matsushita ..... G03G 15/50 399/38
2016/0180204 A1* 6/2016 Imoto ..... G03G 15/70 358/1.12

FOREIGN PATENT DOCUMENTS

JP 2010036507 A * 2/2010 ..... B41J 3/4075
JP 2014-84179 A 5/2014

OTHER PUBLICATIONS

JP_2010036507_A_T Machine Translation, Nishimura, 2010, Japan.*

* cited by examiner

*Primary Examiner* — Victor Verbitsky
(74) *Attorney, Agent, or Firm* — Muncy, Geissler, Olds & Lowe, P.C.

(57) ABSTRACT

An image forming apparatus that forms developer images on a continuous medium includes a control part that performs a developer image forming on an intermediate transfer body with an interval; a transfer part that transfers developer images to the continuous medium; an interval detection part that detects the interval of positions to which the developer images; and an interval information memory that stores interval information of the interval. Wherein, the control part obtains the interval information from the interval information memory when starting an operation of forming the developer image, and determines a timing of forming the developer images on the intermediate transfer body based on the interval information, and when the interval is detected by the interval detection part, the control part updates the interval information in the interval information memory based on the interval that is detected.

18 Claims, 10 Drawing Sheets

Fig. 8A
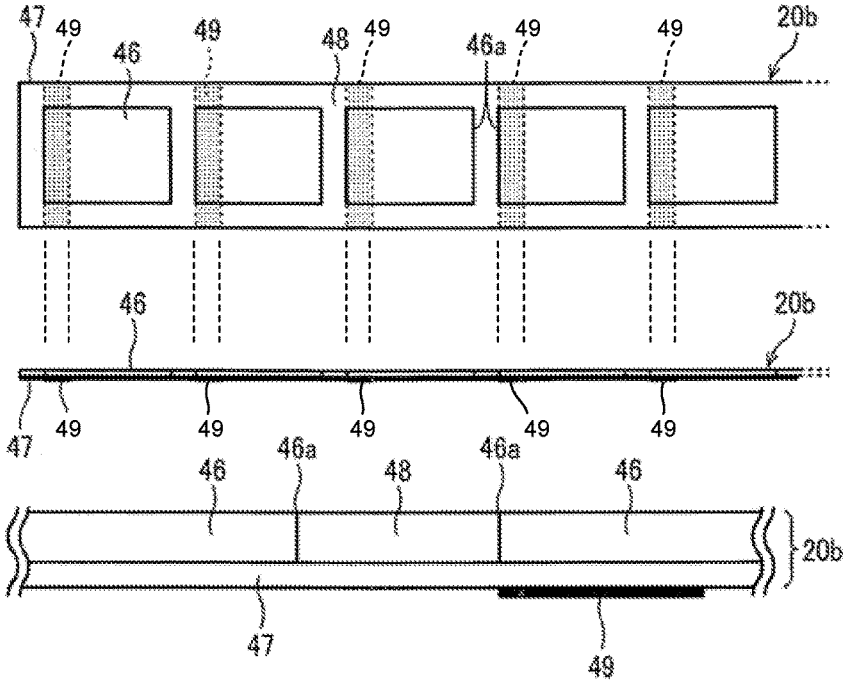
Fig. 8B
Fig. 8C
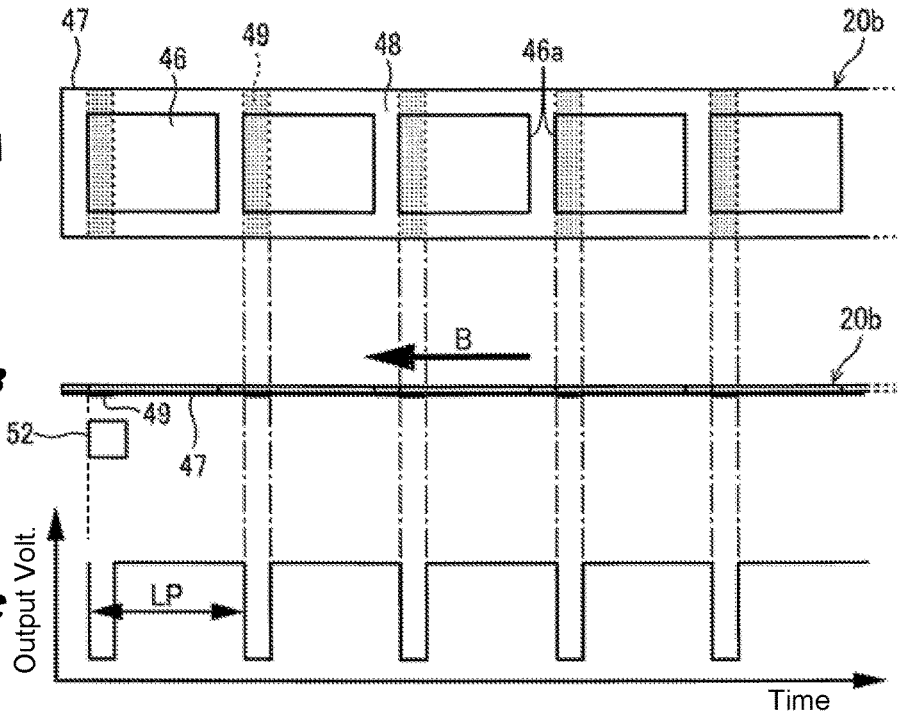
Fig. 9A
Fig. 9B
Fig. 9C (b)

*Fig. 12*

| Name | Type | Label Length [mm] | Label Interval [mm] | Label Width [mm] |
|---|---|---|---|---|
| Label A | Normal Sheet Label | 127 | 3 | 126 |
| Label B | Film Label | 150 | 5 | 100 |
| Label C | Normal Thick Label | 127 | 3 | 126 |
| Label D | Normal Sheet Label | 150 | 10 | 126 |
| ⋮ | ⋮ | ⋮ | ⋮ | ⋮ |

*Fig. 13*

81

Label A

| | T<15℃ | 15℃≦T≦25℃ | 25℃<T |
|---|---|---|---|
| H<30% | | | |
| 30%≦H≦70% | | | |
| 70%≦H | | | |

811

Label B

| | T<15℃ | 15℃≦T≦25℃ | 25℃<T |
|---|---|---|---|
| H<30% | | | |
| 30%≦H≦70% | | | |
| 70%≦H | | | |

812

Label C

| | T<15℃ | 15℃≦T≦25℃ | 25℃<T |
|---|---|---|---|
| H<30% | | | |
| 30%≦H≦70% | | | |
| 70%≦H | | | |

813

Label D

| | T<15℃ | 15℃≦T≦25℃ | 25℃<T |
|---|---|---|---|
| H<30% | | | |
| 30%≦H≦70% | | | |
| 70%≦H | | | |

814

⋮

*Fig. 14*

Initial Value

| | T<15℃ | 15℃≦T≦25℃ | 25℃<T |
|---|---|---|---|
| H<30% | 130.00 | 130.00 | 130.00 |
| 30%≦H≦70% | 130.00 | 130.00 | 130.00 |
| 70%≦H | 130.00 | 130.00 | 130.00 |

811a

Pre-Feeding

| | T<15℃ | 15℃≦T≦25℃ | 25℃<T |
|---|---|---|---|
| H<30% | 130.12 | 130.12 | 130.12 |
| 30%≦H≦70% | 130.12 | 130.12 | 130.12 |
| 70%≦H | 130.12 | 130.12 | 130.12 |

811b

After First Printing

| | T<15℃ | 15℃≦T≦25℃ | 25℃<T |
|---|---|---|---|
| H<30% | 130.12 | 130.12 | 130.12 |
| 30%≦H≦70% | 130.12 | 130.15 | 130.12 |
| 70%≦H | 130.12 | 130.12 | 130.12 |

811c

LAV1

After Second Printing

| | T<15℃ | 15℃≦T≦25℃ | 25℃<T |
|---|---|---|---|
| H<30% | 130.12 | 130.12 | 130.12 |
| 30%≦H≦70% | 130.12 | 130.15 | 130.17 |
| 70%≦H | 130.12 | 130.12 | 130.12 |

811d

LAV2

⋮

IMAGE FORMING APPARATUS THAT ADJUSTS IMAGE FORMATION TIMING BASED ON IMAGE TRANSFER POSITION

CROSS REFERENCE TO RELATED APPLICATION

This application claims priority under 35 USC 119 to Japanese Patent Application No. 2016-020834 filed on Feb. 5, 2016 original document, the entire contents which are incorporated herein by reference.

The present invention relates to an image forming apparatus that is an electrophotographic image forming apparatus adopting an intermediate transfer method and forms an image on a continuous medium.

BACKGROUND

In a conventional image forming apparatus, when an image forming unit that forms a toner image primarily transfers the toner image onto an intermediate transfer belt and secondarily transfers the toner image onto a recording medium, a position at which the toner image is formed on the intermediate transfer belt and a position of the recording medium are detected and a carrying speed of the recording medium is accelerated so that the toner image is formed at a correct position on the recording medium (for example, see Patent Document 1).

RELATED ART

[Patent Doc.] JP Laid-Open Patent Publication 2014-84179

However, in the conventional technology, when a toner image is formed on a continuous sheet such as label roll or pre-printing continuous sheet, there is a problem that a position at which the toner image is to be formed on the continuous sheet and a position at which the toner image is actually formed deviate from each other. The present invention is intended to solve such a problem and to suppress the deviation between the position at which the toner image is to be formed on the continuous sheet and the position at which the toner image is actually formed.

SUMMARY

An image forming apparatus that forms developer images on a continuous medium disclosed in the application includes a control part that performs control in which developer images are formed on an intermediate transfer body with an interval; a transfer part that transfers the developer images to the continuous medium, which is carried along a carrying direction; an interval detection part that is arranged on an upstream side of the transfer part in the carrying direction of the continuous medium and detects the interval of positions to which the developer images are transferred on the continuous medium; and an interval information memory that stores information of the interval detected by the interval detection part, the information being defined as interval information. Wherein, the control part obtains the interval information from the interval information memory when starting an operation of forming the developer image, and determines a timing of forming the developer images on the intermediate transfer body based on the interval information, and when the interval is detected by the interval detection part, the control part updates the interval information in the interval information memory based on the interval that is detected.

According to the present invention, an effect is achieved that the deviation between the position at which the toner image is to be formed on the continuous sheet and the position at which the toner image is actually formed is suppressed.

BRIEF DESCRIPTION OF THE DRAWINGS

FIGS. 8A-8C are explanatory diagrams of black marks of the label roll of the embodiment.

FIGS. 9A-9C are explanatory diagrams of an output of a black mark detection sensor of the embodiment.

FIG. 12 is an explanatory diagram of a medium type table of the embodiment.

FIG. 13 is an explanatory diagram of a reference label pitch table of the embodiment.

FIG. 14 is an explanatory diagram of a measured label pitch table of the embodiment.

DETAILED DESCRIPTION OF THE PREFERRED EMBODIMENT(S)

In the following, with reference to the drawings, an embodiment of an image forming apparatus of the present invention is described.

Figure 1:
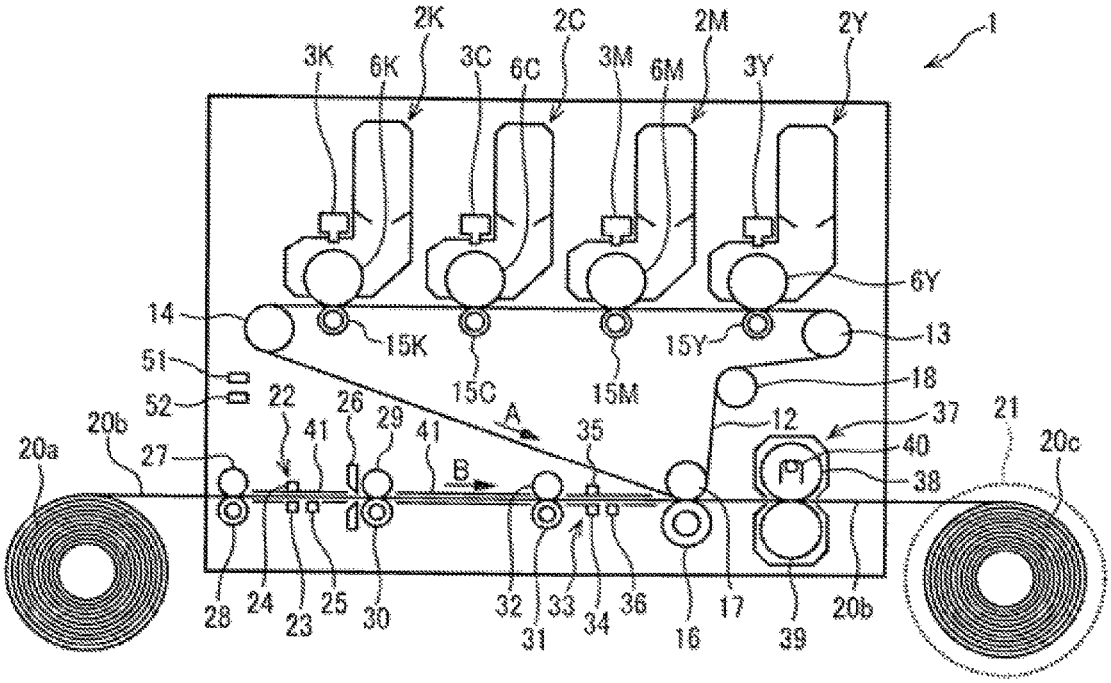
FIG. 1 is a schematic side cross-sectional view illustrating a configuration of an image forming apparatus of an embodiment.

FIG. 1 is a schematic side cross-sectional view illustrating a configuration of the image forming apparatus of the embodiment.

In FIG. 1, an image forming apparatus 1 is, for example, an electrophotographic printer that adopts an intermediate transfer method, and forms an image on a medium that is continuous (hereinafter, the medium is referred to as a "continuous medium"). In the present embodiment, the continuous medium is described as a label roll.

In the image forming apparatus 1, four independent image forming units 2Y, 2M, 2C, 2K are in contact with a surface of an intermediate transfer belt 12. From an upstream side in a rotation direction indicated by an arrow A in the drawing, the image forming unit 2Y, the image forming unit 2M, the image forming unit 2C and the image forming unit 2K are arranged in this order. The image forming units 2Y, 2M, 2C, 2K respectively have Y (yellow), M (magenta), C (cyan) and K (black) toners as developers, and form a toner image as a developer image on the surface of the intermediate transfer belt 12.

Figure 2:
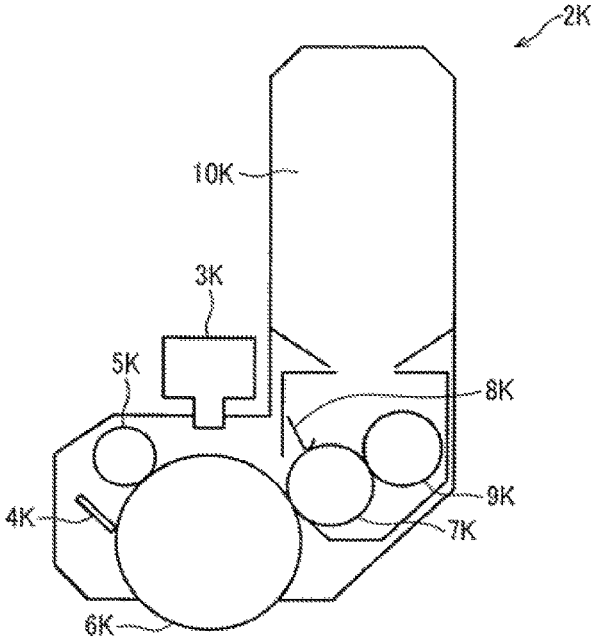
FIG. 2 is a schematic side cross-sectional view illustrating a configuration of an image forming unit of the embodiment.

Here, a configuration of each of the image forming units 2Y, 2M, 2C, 2K as an image forming means is described using the image forming unit 2K as an example based on the schematic side cross-sectional view of FIG. 2 that illustrates the configuration of the image forming unit. In FIG. 2, the image forming unit 2K includes: a photosensitive body 6K; a charge roller 5K that uniformly charges a surface of the photosensitive body 6K; an LED (Light Emitting Diode) head 3K that exposes the surface of the photosensitive body 6K and writes an electrostatic latent image; a development roller 7K that develops the electrostatic latent image formed on the surface of the photosensitive body 6K using toner; a sponge roller 9K that rubs toner between the development roller 7K and the sponge roller 9K to frictionally charge the toner to a negative polarity while supplying the toner to the surface of the development roller 7K; a toner tank 10K that supplies toner to the sponge roller 9K; and a cleaning blade 4K that removes toner remained on the surface of the photosensitive body 6K. The toner tank 10K contains black toner.

The image forming units 2Y, 2M, 2C have the same configuration as the image forming unit 2K, and toners contained in their toner tanks are respectively yellow toner, magenta toner and cyan toner.

Returning to the description of FIG. 1,

The intermediate transfer belt 12 as an intermediate transfer body is stretched by a drive roller 13, an idle roller 14, a secondary transfer backup roller 17 and a tension roller 18, and is rotationally driven by a motor as a drive source in a direction indicated by an arrow A in FIG. 1. Further, primary transfer rollers 15Y, 15M, 15C, 15K are respectively arranged at positions opposing the photosensitive bodies 6Y, 6M, 6C, 6K across the intermediate transfer belt 12.

The primary transfer rollers 15Y, 15M, 15C, 15K are respectively pressed against the photosensitive bodies 6Y, 6M, 6C, 6K by springs as biasing means, and a primary transfer part (primary transfer nip part) is formed between the primary transfer rollers 15Y, 15M, 15C, 15K and the photosensitive bodies 6Y, 6M, 6C, 6K.

In the primary transfer part, transfer of toner images that are formed on the photosensitive bodies 6Y, 6M, 6C, 6K onto the intermediate transfer belt 12 is performed. The intermediate transfer belt 12 holds the transferred toner image on the surface thereof and carries the toner image to a secondary transfer part.

The image forming apparatus 1 has an unprinted label roll 20*a* that is wound as a continuous media. An image is formed on a label sheet 20*b* drawn from the label roll 20*a*. The label sheet 20*b* is wound up by a rewinder 21, and is wound as an image-formation-completed label roll 20*c*.

The label sheet 20*b* drawn from the label roll 20*a* is sandwiched by a sheet feeding roller 28 and a pinch roller 27 and is carried in a carrying direction indicated by an arrow B in FIG. 1, and is guided by a guide 41 to pass through positions at which a transmission type cutting position detection sensor 22 (TCP detection sensor) and a reflection type cutting position detection sensor 25 (RCP detection sensor) are arranged.

The transmission type cutting position detection sensor 22 is a transmission type optical sensor that is formed by a light emitting part 23 and a light receiving part 24 that are arranged so as to sandwich the label sheet 20*b*, and detects a leading edge of each label provided on a front surface of the label sheet 20*b*.

Figure 6A:
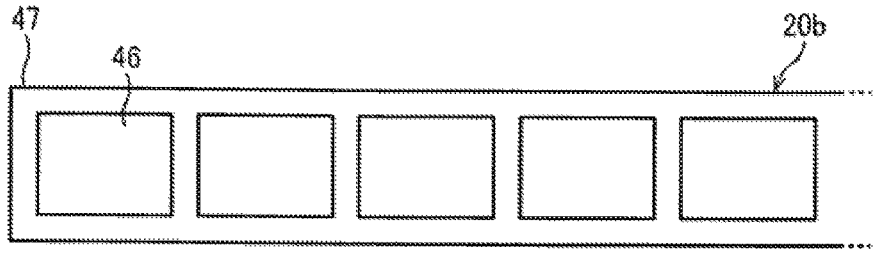
FIGS. 6A-6C are explanatory diagrams of a label roll of the embodiment.
Figure 6B:
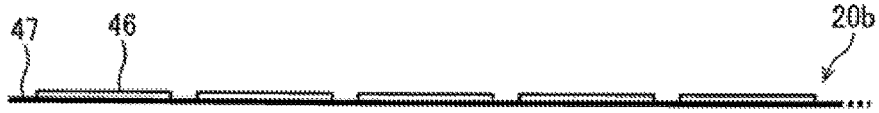
Figure 6C:
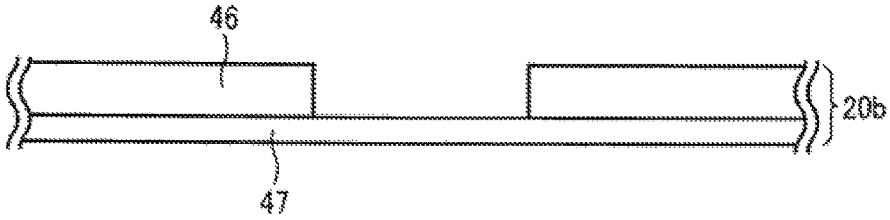

The reflection type cutting position detection sensor 25 is a reflection type optical sensor in which a light receiving part receives reflected light irradiated to the label sheet 20*b* by a light emitting part, and detects a black mark provided on a back surface of the label sheet 20*b*. Here, the label sheet 20*b* that is detected by the transmission type cutting position detection sensor 22 is described based on FIGS. 6A-6C. FIG. 6A is a plan view of the front surface of the label sheet 20*b*. FIG. 6B is a side view of the label sheet 20*b*. FIG. 6C is an enlarged view of a lateral side of the label sheet 20*b*.

In FIG. 6, in the label sheet 20*b*, a plurality of labels 46 are affixed on a continuous mount 47 at a predetermined interval. Between the labels 46, only the mount 47 exists, and label leavings do not exist.

In the label sheet 20*b*, as illustrated in FIGS. 6B and 6C, among a portion where the mount 47 and the labels 46 exist and a portion where only the mount 47 exists, the portion where only the mount 47 exists has a higher light transmittance than the portion where the mount 47 and the labels 46 exist.

Figure 7A:
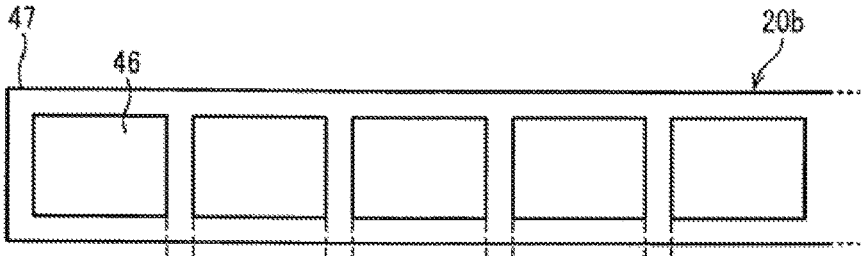
FIGS. 7A-7C are explanatory diagrams of an output of a label gap detection sensor of the embodiment.
Figure 7B:
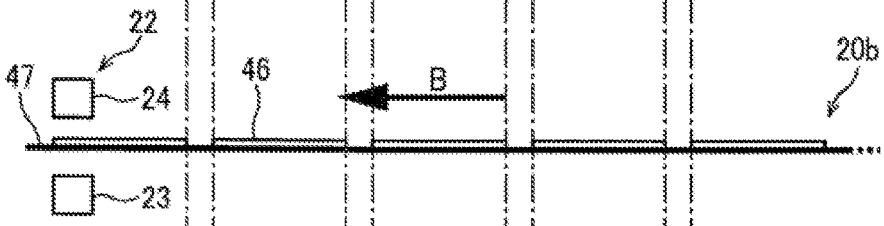
Figure 7C:
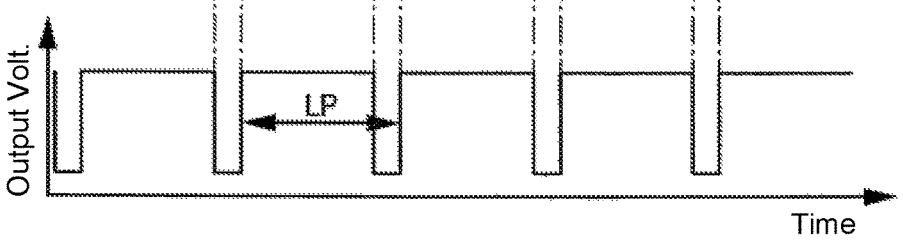

Therefore, as illustrated in FIG. 7B, when the label sheet 20*b* carried in the carrying direction indicated by an arrow B in FIG. 7B passes through, the transmission type cutting position detection sensor 22 outputs an output voltage as illustrated in FIG. 7C. A controller can detect a position of leading edge of each label 46 based on a change in the output voltage, and can detect a label pitch LP that is the interval at which the labels 46 are affixed on the mount 47. FIG. 7A is a plan view of the front surface of the label sheet 20*b*; FIG. 7B is a side view of the label sheet 20*b* and the transmission type cutting position detection sensor 22; and FIG. 7C is a waveform diagram of the output voltage of the transmission type cutting position detection sensor 22.

Further, the label sheet 20*b* that is detected by the reflection type cutting position detection sensor 25 is described based on FIGS. 8A-8C. FIG. 8A is a plan view of the front surface of the label sheet 20*b*; FIG. 8B is a side view of the label sheet 20*b*; and FIG. 8C is an enlarged side view of the label sheet 20*b*.

In FIGS. 8A-8C, in the label sheet 20*b*, a plurality of labels 46 are continuously affixed on the entire front surface of the continuous mount 47. The labels 46 sandwich label leavings 48 and are separated by slits 46*a*.

As illustrated in FIGS. 8B and 8C, on a back surface of the mount 47 of the label sheet 20*b*, a black mark 49 is printed at a leading edge part of each of the labels 46 in accordance with the slits 46*a* of the labels 46.

In the label sheet 20*b*, as illustrated in FIGS. 8B and 8C, among a portion where the black mark 49 is printed and a portion where the black mark 49 is not printed, the portion where the black mark 49 is printed has a lower light reflectance that the portion where the black mark 49 is not printed.

Therefore, as illustrated in FIG. 9B, when the label sheet 20*b* carried in the carrying direction indicated by an arrow B in FIG. 9B passes through, the reflection type cutting position detection sensor 25 outputs an output voltage as illustrated in FIG. 9C. A controller can detect a position of leading edge of each label 46 based on a change in the output voltage, and can detect a label pitch LP that is the interval at which the labels 46 are affixed on the mount 47. FIG. 9A is a plan view of the front surface of the label sheet 20*b*; FIG. 9B is a side view of the label sheet 20*b* and the reflection type cutting position detection sensor 25; and FIG. 9C is a waveform diagram of the output voltage of the reflection type cutting position detection sensor 25.

In this way, the transmission type cutting position detection sensor 22 and the reflection type cutting position detection sensor 25 detect the label pitch LP that is a distance in the carrying direction between leading edges of the labels 46 affixed on the mount 47.

The label sheet 20*b* is described as an object in which, on the back surface of the mount 47, the black mark 49 is printed at the leading edge part of each of the labels 46 in accordance with the slits 46*a* of the labels 46. However, as long as an interval that is the same as the label pitch LP is maintained, it is also possible that the black mark 49 is printed at a position shifted from the leading edge part of each of the labels 46.

Returning to the description of FIG. 1, the label sheet 20*b* is further guided by the guide 41 to reach a cutter 26 and is cut to a predetermined length by the cutter 26.

The label sheet 20*b* is further guided by the guide 41 to be sandwiched by a contact part (hereinafter referred to as a "nip part") between a first intermediate carrying roller 30 and a first pinch roller 29 opposing the first intermediate carrying roller 30, and is carried by the rotation driving of the first intermediate carrying roller 30. Further, the label sheet 20*b* is guided by the guide 41 to be sandwiched by a nip part between a second intermediate carrying roller 32 and a second pinch roller 31 opposing the second intermediate carrying roller 32, and the carried by rotation driving of the second intermediate carrying roller 32.

The label sheet 20*b* is further guided by the guide 41 to pass through positions at which a transmission type write position detection sensor 33 (TWP detection sensor) and a reflection type write position detection sensor 36 (RWP detection sensor) are arranged.

The transmission type write position detection sensor 33 and the reflection type write position detection sensor 36 as interval detection part are arranged on an upstream side of a secondary transfer roller 16 and a secondary transfer backup roller 17 in the carrying direction of the label sheet 20*b* indicated by the arrow B in FIG. 1, and detect an interval of positions on the label sheet 20*b* at which a toner image is transferred.

The transmission type write position detection sensor 33 has the same configuration as the transmission type cutting position detection sensor 22 and is a transmission type optical sensor that is formed by a light emitting part 34 and a light receiving part 35 that are arranged so as to sandwich the label sheet 20*b*, and detects a leading edge of each label provided on the front surface of the label sheet 20*b* and detects an interval (the label pitch LP illustrated in FIGS. 7A-7C) of the labels, which is an interval of positions at which a toner image is transferred.

The reflection type write position detection sensor 36 has the same configuration as the reflection type cutting position detection sensor 25 and is a reflection type optical sensor in which reflected light irradiated from the light emitting part to the label sheet 20*b* is received by the light receiving part, and detects the black marks provided on the back surface of the label sheet 20*b* and detects a interval (the label pitch LP illustrated in FIGS. 9A-9C) of the labels, which is an interval of the positions at which a toner image is transferred.

In this way, similar to the transmission type cutting position detection sensor 22 and the reflection type cutting position detection sensor 25, the transmission type write position detection sensor 33 and the reflection type write position detection sensor 36 detect the label pitch LP, which is a distance in the carrying direction between the leading edges of the labels 46 affixed on the mount 47.

The label sheet 20*b* is further guided by the guide 41 to be carried to a secondary transfer part (secondary transfer nip part) that is formed by the secondary transfer roller 16 and the secondary transfer backup roller 17.

The secondary transfer roller 16 and the secondary transfer backup roller 17, as transfer part, transfer a toner image to the carried label sheet 20*b*. When a toner image is transferred to the label sheet 20*b*, by causing arrival timings of each label and the toner image that has been primarily transferred onto the intermediate transfer belt 12 at the secondary transfer nip part to match each other, the toner image is properly positioned, secondarily transferred and formed at a predetermined positioned of the each label. As explained above, the secondary transfer nip part is formed with the rollers 16 and 17 and denoted with SNP in FIG. 10.

The label sheet 20*b* is further carried to the fuser 37. In the fuser 37, an upper roller 38, in which a halogen heater 40 that supplies heat for dissolving and fusing a toner image is arranged, and a lower roller 39 that is arranged opposing the upper roller 38 are pressed against and in contact with each other and form a fuser nip part. When the label sheet 20*b* is sandwiched and carried by the fuser nip part, the secondarily transferred toner image is fused by heat and pressure.

The label sheet 20*b* on which the toner image is fused by the fuser 37 is wound on the rewinder 21. The rewinder 21 rotates by being driven by a motor or the like and winds the label sheet 20*b* that is being continuously printed. The fuser nip part is denoted with FNP in FIGS. 11A and 11B.

In the image forming apparatus 1, in order to measure temperature and humidity of an environment in which the image forming apparatus 1 is arranged, a temperature sensor 51 as a temperature detection part that measures (detects) the environmental temperature and a humidity sensor 52 as a humidity detection part that measures (detects) the environmental humidity are provided.

In this way, the image forming apparatus 1 can continuously form images on the label sheet 20*b* drawn from the label roll 20*a*.

Figure 3B:
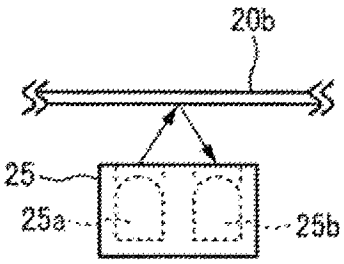
FIGS. 3A and 3B are explanatory diagrams of a reflection type cutting position detection sensor and a reflection type write position detection sensor of the embodiment.
Figure 3A:
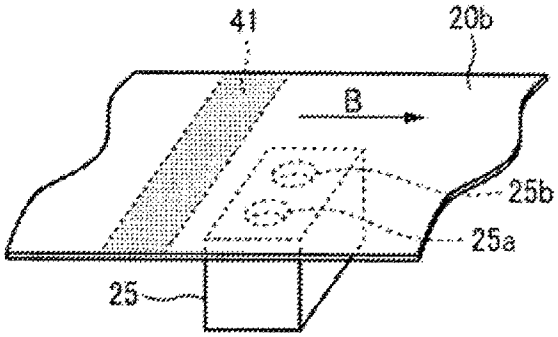

FIGS. 3A and 3B are explanatory diagrams of the reflection type cutting position detection sensor and the reflection type write position detection sensor of the embodiment. FIG. 3A is a perspective view of the reflection type cutting position detection sensor; and FIG. 3B is a side view of the reflection type cutting position detection sensor. Further, the reflection type write position detection sensor 36 illustrated in FIG. 1 also has the same configuration.

In FIG. 3, the reflection type cutting position detection sensor 25 detects the black mark 49 printed on the back surface of the label sheet 20*b*, and has an LED 25*a* as a light emitting means and a phototransistor 25*b* as a light receiving means. The light emitting means is not limited to an LED, and the light receiving means is also not limited to a phototransistor. Other kinds of elements or the like may also be used as long as the elements or the like can function as a light emitting means or a light receiving means.

The LED 25*a* is driven by a drive circuit, and irradiates light at a predetermined emission intensity to the back surface of the label sheet 20*b*.

The phototransistor 25*b*, using a drive circuit and a read circuit, outputs a voltage according to a reflected light intensity of the back surface of the label sheet 20*b*. In the present embodiment, the phototransistor 25*b* is configured such that an output voltage at a position of the black mark 49, where the light reflectance is lower than the surroundings, is lower.

Figure 4A:
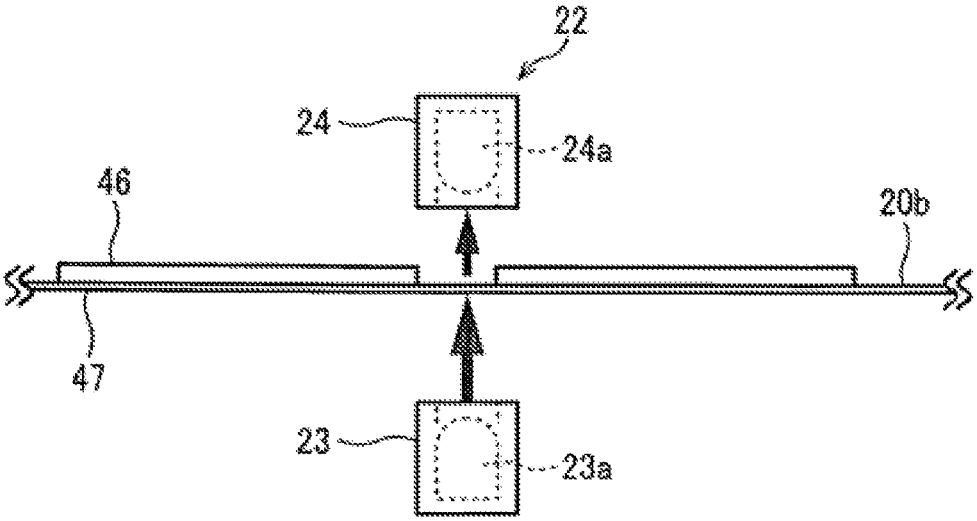
FIGS. 4A and 4B are explanatory diagrams of a transmission type cutting position detection sensor and a transmission type write position detection sensor of the embodiment.
Figure 4B:
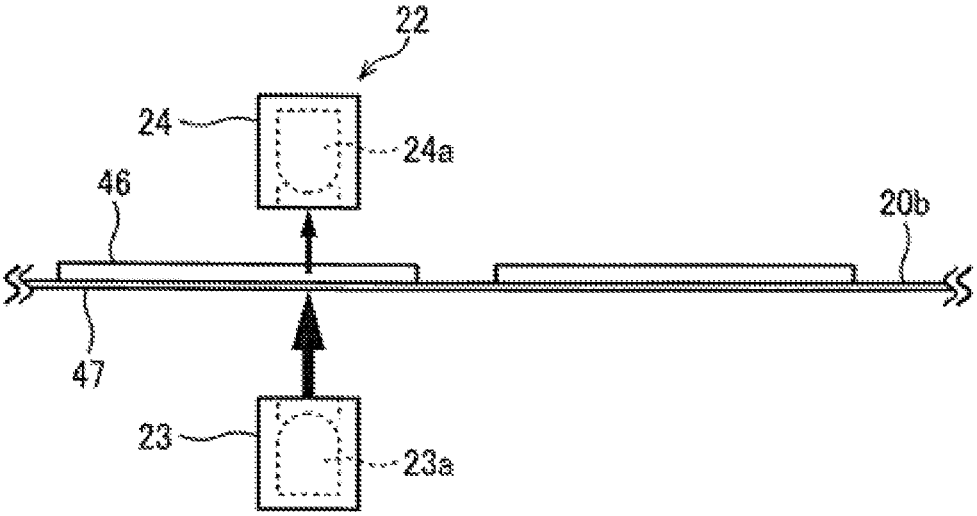

FIGS. 4A and 4B are explanatory diagrams of the transmission type cutting position detection sensor and the transmission type write position detection sensor of the embodiment. FIG. 4A illustrates a state of detecting a portion between the labels 46; and FIG. 4B illustrates a state of detecting a label 46. The transmission type write position detection sensor 33 illustrated in FIG. 1 also has the same configuration.

In FIGS. 4A and 4B, the transmission type cutting position detection sensor 22 detects the labels 46 affixed on the front surface of the label sheet 20*b*, and has the light emitting part 23 that is arranged below the label sheet 20*b* and the light receiving part 24 that is arranged above the label sheet 20*b*. The light emitting part 23 and the light receiving part 24 are arranged opposing each across the label sheet 20*b*.

An LED 23*a* as a light emitting means is fixed inside the light emitting part 23. The LED 23*a* is driven by a drive circuit, and irradiates light of a predetermined amount of luminescence to the front surface of the label sheet 20*b*.

A phototransistor 24*a* as a light receiving means is fixed inside the light receiving part 24. The phototransistor 24*a*, using a drive circuit and a read circuit, receives light of the LED 23*a* transmitted through the label sheet 20*b* and outputs a voltage according to an amount of the received light. In the present embodiment, the phototransistor 24*a* is configured such that an output voltage at a position between the labels 46, where the light transmittance is higher than the surroundings, is lower.

The light emitting means is not limited to an LED, and the light receiving means is also not limited to a phototransistor. Other kinds of elements or the like may also be used as long as the elements or the like can function as a light emitting means or a light receiving means. Further, it is also possible that the light receiving part 24 is arranged below the label sheet 20*b* and the light emitting part 23 is arranged above the label sheet 20*b*.

Figure 5:
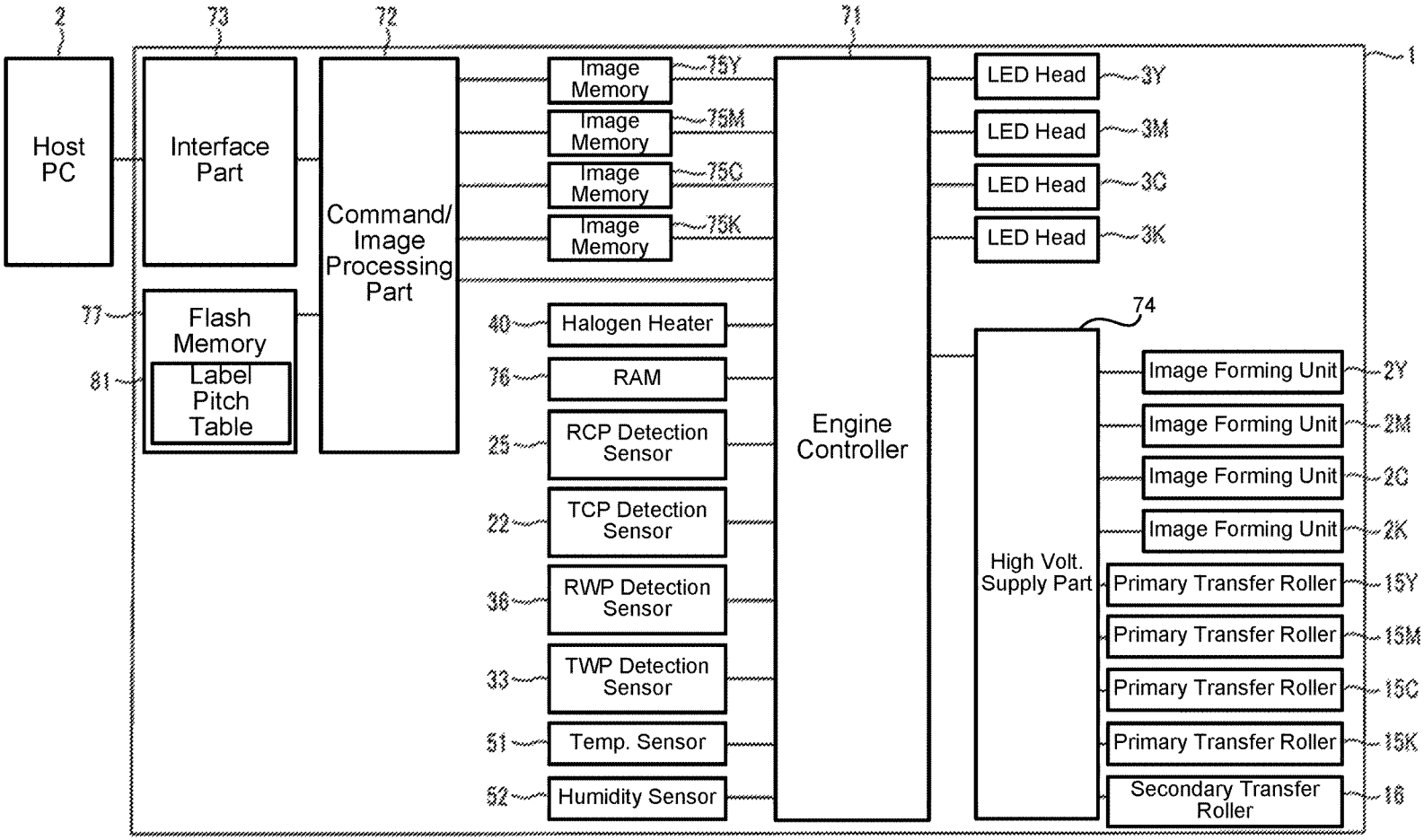
FIG. 5 is a block diagram illustrating a control configuration of an image forming apparatus of the embodiment.

FIG. 5 is a block diagram illustrating a control configuration of the image forming apparatus of the embodiment.

In FIG. 5, the image forming apparatus 1 has an engine controller 71, a command/image processing part 72, an interface part 73, a high-voltage supply part 74, image memories 75Y, 75M, 75C, 75K, a RAM (Random Access Memory) 76, and a flash memory 77.

The engine controller 71 as a control part includes a CPU (Central Processing Unit) and the like and controls operation of the entire image forming apparatus 1. The engine controller 71 is connected to the LED heads 3Y, 3M, 3C, 3K, the high-voltage supply part 74, the RAM 76, the halogen heater 40, the reflection type cutting position detection sensor 25, the transmission type cutting position detection sensor 22, the reflection type write position detection sensor 36, the transmission type write position detection sensor 33, the temperature sensor 51, and the humidity sensor 52.

The engine controller 71, together with the command/image processing part 72, as a control part performs control to form a toner image on the intermediate transfer belt 12 as an intermediate transfer body illustrated in FIG. 1 using the image forming units 2Y, 2M, 2C, 2K. The interface part 73 performs communication with a host PC (Personal Computer) 2 that is connected via a communication line.

The command/image processing part 72 as a control part processes a command and image data received from the host PC 2 via the interface part 73 and generates bitmap data. The command/image processing part 72 outputs an instruction to the engine controller 71 according to a command received from the host PC 2, and performs interpretation of image data and expansion of the image data to bitmap data, and writes the expanded bitmap data to the image memories 75Y, 75M, 75C, 75K corresponding to the colors of yellow, magenta, cyan and black.

The image memories 75Y, 75M, 75C, 75K are RAMs that are connected to the LED heads 3Y, 3M, 3C, 3K via the engine controller 71. The engine controller 71 reads the bitmap data written to the image memories 75Y, 75M, 75C, 75K and transfers the bitmap data to the LED heads 3Y, 3M, 3C, 3K.

The high-voltage supply part 74 is connected to the image forming units 2Y, 2M, 2C, 2K, the primary transfer rollers 15Y, 15M, 15C, 15K, and the secondary transfer roller 16, and supplies a required high voltage to each of the image forming units 2Y, 2M, 2C, 2K, the primary transfer rollers 15Y, 15M, 15C, 15K, and the secondary transfer roller 16.

The RAM 76 stores data that is temporarily generated when the engine controller 71 performs each process.

The flash memory 77 is a nonvolatile storage means that is connected to the command/image processing part 72. An operation program of the command/image processing part 72 is stored in the flash memory 77. The command/image processing part 72 performs each process according to the operation program.

The operation program stored in the flash memory 77 contains a medium type table 80 illustrated in FIG. 12 and a label pitch table 81 illustrated in FIG. 13. The command/image processing part 72 generates bitmap data with reference to the medium type table 80 and the label pitch table 81 and outputs an instruction to the engine controller 71.

FIG. 12 is an explanatory diagram of the medium type table of the embodiment. In FIG. 12, the medium type table 80 is a table that stores information about reference values of label pitches by associating each continuous medium with image forming conditions such as a type of a material or the like (medium type), a label length, a label interval, a label width (medium size) and the like, and a name is given to each continuous medium. Here, the label length is a length of a label affixed on the label sheet 20*b* illustrated in FIG. 1 in the medium carrying direction indicated by the arrow B in FIG. 1; the label interval is a distance in the medium carrying direction between adjacent labels affixed on the label sheet 20*b* (distance between a trailing edge of a label and a leading edge of a following label); and the label width is a length of a label affixed on the label sheet 20*b* in a direction orthogonal to the medium carrying direction.

The image forming condition may be input by an operator through an input device or may be read from an embedded mark in the medium using a sensor.

Further, even for labels of the same type such as a label A and a label D, the medium sizes such as the label length, the label interval, the label width, and the like may be different. By selecting from the medium type table 80 a type of a medium to be used in printing by the image forming apparatus 1 via an operation panel as an operation display part or software such as a printer driver installed in the host PC 2, a user can perform appropriate image formation on a loaded medium.

FIG. 13 is an explanatory diagram of a reference label pitch table of the embodiment. In FIG. 13, the label pitch table 81 as an interval information memory is a table that stores a length as a label pitch (the label pitch LP illustrated in FIGS. 7A-7C or FIGS. 9A-9C) in association with the name of each continuous medium, that is, the image forming conditions of each continuous medium, the length being obtained by adding a label length and a label interval that are detected by the reflection type write position detection sensor 36 or the transmission type write position detection sensor 33 during an operation in which the image forming apparatus 1 illustrated in FIG. 1 feeds the label sheet 20*b* or during a print operation in which a toner image is formed.

The label pitch table 81 is formed by label pitch tables of the respective names of the continuous media (for example, a label pitch table 811 of the label A, a label pitch table 812 of the label B, a label pitch table 813 of the label C, a label pitch table 814 of the label D, and the like) in association with the image forming conditions.

Further, the label pitch table 811 can hold an interval (the label length+the label interval) of the black marks as a label pitch for each of a total of 9 combinations of levels of 3 levels of the environmental temperature and 3 levels of the environmental humidity. Each of the numbers of the levels is not limited to 3 levels, but may also be 4 levels or more and 2 levels or less. Further, it is also possible that the number of the levels of the environmental temperature and the number of the levels of the environmental humidity are different from each other. In this way, the label pitch table 811 can store a label pitch in association with the environmental temperature and the environmental humidity detected by the temperature sensor 51 and the humidity sensor 52.

In the present embodiment, the image forming conditions are defined as follows: 1) the medium type such as the type of the material, 2) medium sizes such as the label length, the label interval and the label width, 3) the environmental temperature and 4) the environmental humidity. However, it is sufficient that at least one of the medium type, the medium sizes, the environmental temperature and the environmental humidity is included. Values of the label pitch table 81 are rewritable so that a value of a label pitch detected by a sensor can be updated. In the invention, the environmental temperature and the environmental humidity may be defined as an environmental condition.

The engine controller 71 and the command/image processing part 72 illustrated in FIG. 5 control the timing of the formation of a toner image on the intermediate transfer belt 12 illustrated in FIG. 1 based on the label pitch stored in the label pitch table 81 in association with the image forming conditions, and, when a label pitch is detected by the reflection type write position detection sensor 36 or the transmission type write position detection sensor 33, update the information about the label pitch of the label pitch table 81 based on the information of the detected label pitch.

Further, the engine controller 71 and the command/image processing part 72 illustrated in FIG. 5 detect the label pitch using the reflection type write position detection sensor 36 or the transmission type write position detection sensor 33 during an operation in which the image forming apparatus 1 illustrated in FIG. 1 feeds the label sheet 20*b* or during a print operation in which a toner image is formed. These controllers and processing part disclosed in the application are embodied with a microprocessor and appropriate software.

An effect of the above-described configuration is described.

First, a print operation of the image forming apparatus is described with reference to FIGS. 1 and 5. The print operation starts from a state in which the label sheet 20*b* drawn from the label roll 20*a* passes through the secondary transfer part, which is formed by the secondary transfer roller 16 and the secondary transfer backup roller 17, and the fuser 37 and is wound around the rewinder 21. The printing of the present embodiment is so-called roll-to-roll printing in which an image is continuously formed on the labels on the label sheet 20*b*.

In the present embodiment, it is described that, as illustrated in FIGS. 8A-8C, a black mark is printed on the back surface of the mount of a leading edge part of each of the labels of the label roll 20*a* (label sheet 20*b*), and the label pitch is detected by detecting the black marks using the reflection type write position detection sensor 36.

The command/image processing part 72 of the image forming apparatus 1 starts an image forming operation when receives a command and image data from the host PC 2 via the interface part 73. The command/image processing part 72 interprets the received command and image data, expands the image data to bitmap data of respective toner colors, and writes the expanded bitmap data to the image memories 75Y, 75M, 75C, 75K.

Further, at the same time as the expansion to the bitmap data, the command/image processing part 72 outputs an instruction to start a print operation to the engine controller 71 according to the command received from the host PC 2.

The engine controller 71 controls the halogen heater 40 to warm up the fuser 37 such that the fuser 37 is in a temperature range that allows a toner image to be fused on the label sheet 20*b*. When the fuser 37 is warmed up, the engine controller 71 starts to drive the drive roller 13, the image forming units 2Y, 2M, 2C, 2K, the sheet feeding roller 28, the first intermediate carrying roller 30, the second intermediate carrying roller 32, the fuser roller 38 and the rewinder 21.

The speed at which the drive roller 13 drives the intermediate transfer belt 12 is substantially the same as the speed at which the sheet feeding roller 28, the first intermediate carrying roller 30, the second intermediate carrying roller 32, the fuser roller 38 and the rewinder 21 carry the label sheet 20*b*.

The engine controller 71 simultaneously controls the high-voltage supply part 74 to supply a predetermined high voltage bias (hereinafter referred to as a "bias") to each of the image forming units 2Y, 2M, 2C, 2K and the primary transfer rollers 15Y, 15M, 15C, 15K.

Here, an operation of forming a toner image on each of the photosensitive bodies 6Y, 6M, 6C, 6K is described with reference to FIG. 2 using the image forming unit 2K as an example. A charge bias of −1000 V is supplied from the high-voltage supply part 74 to the charge roller 5K, and the surface of the photosensitive body 6K is charged to −600 V. Further, a development bias of −200 V and a sponge bias of −250 V are respectively supplied from the high-voltage supply part 74 to the development roller 7K and the sponge roller 7K.

Toner supplied from a toner cartridge 10K is strongly rubbed against the sponge roller 9K and the development roller 7K to be frictionally charged to a negative polarity. The negatively charged toner is attached to the development roller 7K due to a potential difference between the sponge bias and the development bias.

The toner attached to the development roller 7K is caused to have a uniform thickness by a developing blade 8K and a toner layer is formed on the development roller 7K. The toner layer formed on the development roller 7K is carried by the rotation of the development roller 7K to a nip part between the development roller 7K and the photosensitive body 6K.

On the other hand, the engine controller 71 starts writing a latent image to the photosensitive body 6K using the LED head 3K. The engine controller 71 sequentially reads bitmap data of a black image written in the image memory 75K from a leading edge of the image and sequentially transfers the bitmap data to the LED head 3K in units of one line. The LED head 3K blinks the LED according to the transferred bitmap data and exposes the surface of the photosensitive body 6K that is charged to −600 V. An exposed portion of the photosensitive body 6K is destaticized to −50 V and becomes an electrostatic latent image.

The portion of the photosensitive body 6K where the electrostatic latent image is formed is carried by the rotation of the photosensitive body 6K to the nip part between the photosensitive body 6K and the development roller 7K. A negatively charged toner layer is formed on the development roller 7K, and a development bias of −200 V is supplied to the development roller 7K. Therefore, due to a potential difference between the development roller 7K and the electrostatic latent image, toner selectively attaches only to the portion of the electrostatic latent image and a toner image is developed.

Similarly, a toner image is also formed on each of the photosensitive bodies 6Y, 6M, 6C of the image forming units 2Y, 2M, 2C.

In this way, when toner images are formed on the photosensitive bodies 6Y, 6M, 6C, 6K, before the toner images reach the primary transfer part, which is the contact part between the intermediate transfer belt 12 and the photosensitive bodies 6Y, 6M, 6C, 6K, the high-voltage supply part 74 supplies a primary transfer bias to each of the primary transfer rollers 15Y, 15M, 15C, 15K, causing the toner images formed on the photosensitive bodies 6Y, 6M, 6C, 6K to be transferred to and laminated on the intermediate transfer belt 12. Timings of forming the toner images on the photosensitive bodies 6Y, 6M, 6C, 6K are shifted according to the intervals at which the photosensitive bodies 6Y, 6M, 6C, 6K are arranged. Therefore, the toner images are superimposed and laminated without being shifted from each other on the intermediate transfer belt 12.

Next, control of timing of writing a head image to the label sheet is described with reference to FIGS. 1 and 5.

As described above, when the fuser 37 warms up, the label sheet 20*b* is started to be carried at substantially the same speed as the traveling speed of the intermediate transfer belt 12. At the same time, the engine controller 71 acquires the environmental temperature and humidity using the temperature sensor 51 and the humidity sensor 52.

When the carrying speed of the label sheet 20*b* reaches a target speed and the speed is stabilized, the reflection type write position detection sensor 36 starts to detect the black marks on the back side of the label sheet 20*b*.

The reflection type write position detection sensor 36 that has started to detect the black marks on the back side of the label sheet 20*b* detects a first black mark. A leading edge of this black mark is a leading edge position of a label.

When the label corresponding to the first black mark is a first label and an initial label to which a leading toner image transferred to the intermediate transfer belt 12 can be transferred is an Nth label, the number N is calculated by the engine controller 71 and the command/image processing part 72 as follows.

Figure 10:
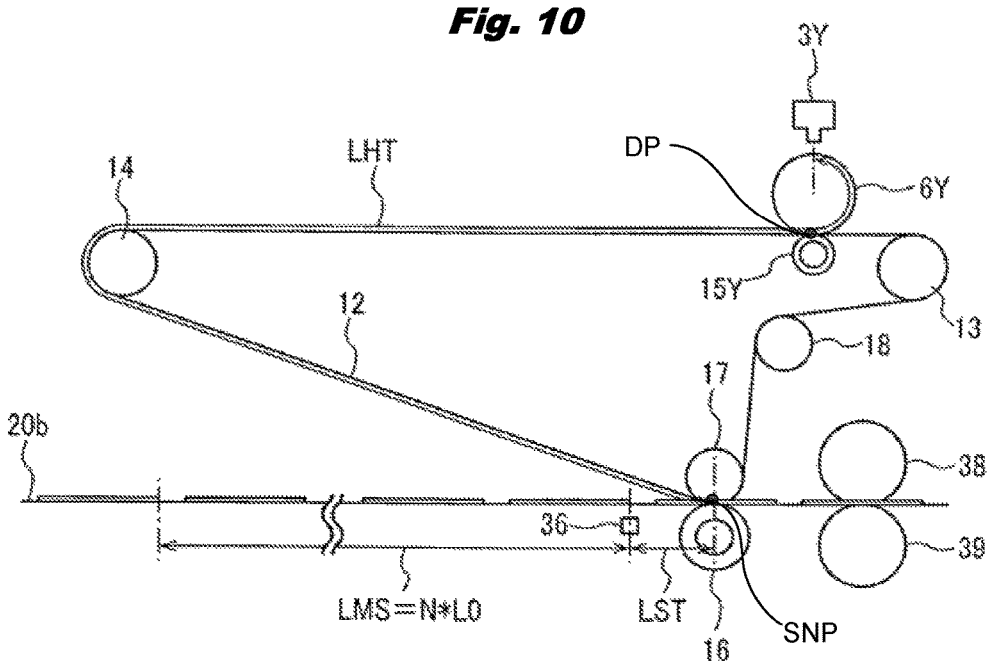
FIG. 10 is an explanatory diagram of write timing of a head image of the embodiment.

As illustrated in FIG. 10, a distance from a position at which the LED head 3Y exposes the photosensitive body 6Y to a secondary transfer position along a path along which a latent image and a developed toner image are carried is LHT, and a distance from the reflection type write position detection sensor 36 to the secondary transfer position is LST.

Further, the command/image processing part 72 acquires a reference label pitch L0 from the label pitch table 81 as a reference. In this case, the command/image processing part 72 selects a label pitch table as a reference according to the type of the label sheet 20*b*. For example, in the case of the label A, the label pitch table 811 is selected. Further, the command/image processing part 72 acquires the reference label pitch L0 based on the selected label pitch table and the environmental temperature and humidity acquired by the temperature sensor 51 and the humidity sensor 52.

In this case, the number N is calculated using Equation 1.

$$N=\text{Roundup}\{(LHT-LST)/L0\}+1 \quad \text{(Equation 1)}$$

Here, Roundup indicates a function to round up to a nearest integer.

Next, in order to properly transfer the leading toner image to the Nth label at a predetermined position, timing for the LED 3Y to start exposure is calculated as follows. When a distance from where the black mark of the first label is detected by the reflection type write position detection sensor 36 to where the LED head 3Y starts exposure is LF, the distance LF is calculated by the engine controller 71 and the command/image processing part 72 based on Equation 2.

$$LF=(N-1)\times L0-(LHT-LST) \quad \text{(Equation 2)}$$

Here, the distance LF calculated using Equation 2 uses the reference label pitch L0 stored in the label pitch table 81. Therefore, there is a possibility that there is a difference between the reference label pitch L0 and a label pitch L that is detected by the reflection type write position detection sensor 36 during actual printing. When the difference between L0 and L is ΔL, a write position of a toner image is shifted by an amount of (N−1)×ΔL.

Therefore, in the present embodiment, in order to reduce the difference ΔL as much as possible, the label pitch table 81 is updated during a print operation.

FIG. 14 is an explanatory diagram of a measured label pitch table of the embodiment, and illustrates states in which the label pitch table 811 of the label A illustrated in FIG. 13 is used as an initial value and the pitch table is sequentially updated after pre-feeding, after first printing, after second printing, and the like.

First, a case where the image forming apparatus 1 prints the label A for the first time is described.

As described above, before the printing is started, the label sheet 20*b* is in a state of being passed through the secondary transfer part, which is formed by the secondary transfer roller 16 and the secondary transfer backup roller 17, and the fuser 37 and wound around the rewinder 21. In order to achieve this pre-printing state, the image forming apparatus 1 performs a pre-feeding operation before the printing is started.

Figure 11A:
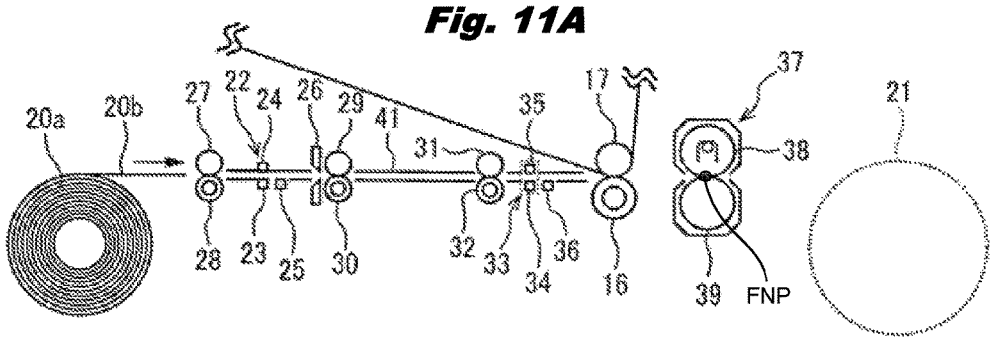
FIGS. 11A and 11B are explanatory diagrams of a pre-feeding operation of the embodiment.
Figure 11B:
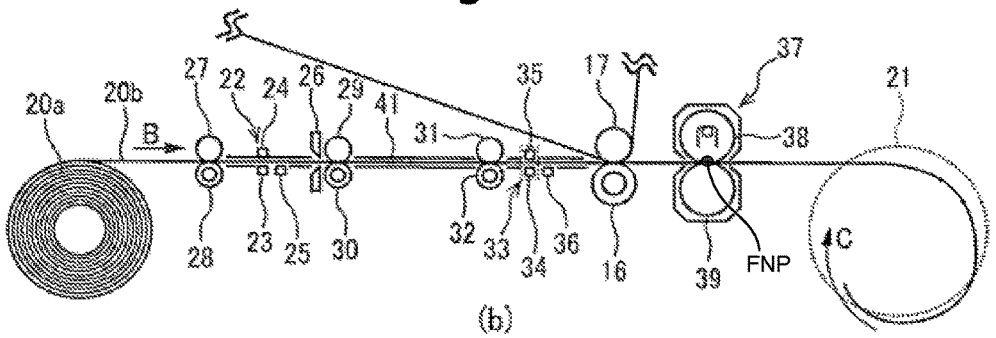

The pre-feeding operation is described based on FIGS. 11A, 11B and 5. FIG. 11A illustrates a state before the pre-feeding operation is started. FIG. 11B illustrates a state after the pre-feeding operation is completed.

As illustrated in FIG. 11A, a user inserts a leading edge of the label sheet 20*b* drawn from the label roll 20*a* into a nip part between the sheet feeding roller 28 and the pinch roller 27. Thereafter, the user operates an operation part such as an operation panel to issue an instruction to execute pre-feeding.

The engine controller 71 starts to drive the drive roller 13, the sheet feeding roller 28, the first intermediate carrying roller 30, the second intermediate carrying roller 32 and the fuser roller 38 to carry the label sheet 20*b*, and stops the driving when the label sheet 20*b* is carried into a state in which the leading edge of the label sheet 20*b* is sufficiently fed out from the fuser 37. As illustrated in FIG. 11B, the user winds the fed out leading edge part of the label sheet 20*b* around the rewinder 21 (in a direction indicated by an arrow C in FIG. 11B) to put the label sheet 20*b* in a print-ready state, and completes pre-feeding operation.

During the pre-feeding operation, the engine controller 71 detects the black marks using the reflection type write position detection sensor 36. During the period until the label sheet 20*b* is carried to the position where the pre-feeding operation is completed, multiple black marks can be detected, and an average value of intervals of the detected black marks is used as the reference label pitch L0.

When the pre-feeding operation is started, the engine controller 71 and the command/image processing part 72 initialize the label pitch table 81 based on the reference values of the medium type table 80 illustrated in FIG. 12. Therefore, before the pre-feeding operation is started, in the label pitch table 811*a* illustrated in FIG. 14, an interval (label length+label interval) of black marks is set as an initial value (for example, 130.00) based on the information of the reference values of the medium type table 80 illustrated in FIG. 1 The values of the medium type table 80, for example, are based on product specifications of the label rolls, and may be different from values that are actually detected during printing.

After the pre-feeding operation, the engine controller 71 and the command/image processing part 72 rewrite all the values of the label pitch table 811*a* with the average value L0 (for example, 130.12) of the intervals of the black marks detected during the pre-feeding operation and use the resulting label pitch table as a label pitch table 811*b* after the pre-feeding.

In a first print operation, the distance LF from where the black mark of the first label is detected by the reflection type write position detection sensor 36 to where the LED head 3Y starts exposure is calculated by the engine controller 71 and the command/image processing part 72 based on the above-described Equation 2 using the interval L0 of the black marks of the label pitch table 811*b* after the pre-feeding, and the timing of exposure by the LED head 3Y is determined.

During the first print operation, the engine controller 71 continues to detect the black marks using the reflection type write position detection sensor 36, and at the same time measures intervals of the black marks, and holds the intervals as a measured label pitch value array in the RAM 76. The measured label pitch value array, for example, contains eight latest values, and an average value of the eight latest values is used as a label pitch average value LAV detected during the printing.

After the first print operation is completed, the engine controller 71 notifies the command/image processing part 72 of the label pitch average value LAV. The command/image processing part 72 rewrites a label pitch of corresponding environmental temperature and environmental humidity (for example, an environmental temperature of 15° C. or more and less than 25° C. and an environmental humidity of 30% or more and less than 70%) of the label pitch table 811*b* with the label pitch average value LAV1 (for example, 130.15) notified from the engine controller 71, and uses the resulting label pitch table as a label pitch table 811*c* after the first print operation.

When a second or subsequent print operation is completed, similarly, each time a print operation is completed, the command/image processing part 72 rewrites a label pitch of corresponding environmental temperature and environmental humidity (for example, an environmental temperature of higher than 25° C. and an environmental humidity of 30% or more and less than 70%) of the label pitch table with the label pitch average value LAV2 (for example, 130.17) notified from the engine controller 71, and uses the resulting label pitch table as, for example, a label pitch table 811*d* after the second print operation.

At the following printing operation, these sensors detect the temperature and humidity. The controller determines and obtains a label pitch average value LVA, which corresponds to the detected temperature and humidity, from table 811. The controller determines the timing of exposure of LED head 3Y and causes the LED head 3Y to expose at the determined timing.

In this way, during the pre-feeding operation or during the print operation, the label pitch table is updated based on a measured value of the interval of the black marks measured using the reflection type write position detection sensor 36. Thereby, a value close to the label pitch measured using the reflection type write position detection sensor 36 is always maintained, and an error in the write position of the leading toner image can be minimized.

Since the label pitch of the label pitch table is maintained for each environmental temperature and humidity, the error in the write position of the toner image can be minimized by also absorbing a change in an carrying amount caused by expansion or contraction of the label sheet 20*b* or expansion or contraction of the rollers such as the carrying roller due to a change in the temperature and humidity.

Further, by storing the label pitch table for each type of medium in the flash memory 77 as a nonvolatile memory, even when the label roll is replaced, the error in the write position of the leading toner image can be minimized.

Here, a problem that occurs when the label pitch is not updated based on a value measured using the sensor is described.

In the electrophotographic image forming apparatus 1 that adopts an intermediate transfer method, when an image is formed on a continuous medium such as a label roll or a pre-printing continuous sheet on which a position at which an image is formed is specified, there is a possibility that a positioned at which an image is to be formed on the continuous medium and a position at which the image is actually formed on the continuous medium deviate from each other. In the following, the continuous medium on which a position at which an image is formed is specified is described as a label roll. However, the same also applies to any other "continuous medium on which a position at which an image is formed is specified" other than a label roll.

In an image forming apparatus adopting an intermediate transfer method that forms an image on a label roll, usually, a label position detection member such as a sensor is arranged near (generally, within 100 mm of) a secondary transfer part on an upstream side in a medium carrying direction, and an image position or an image formation pitch is adjusted based on a label position detection result. This is because, by detecting a position of a label near the secondary transfer part, the label position can be detected with a medium carrying speed at the secondary transfer position, and an accurate label position can be detected.

On the other hand, in the image forming apparatus 1 that adopts an intermediate transfer method, a distance from the secondary transfer position to an exposure source of the LED head 3Y positioned on a most upstream side in the traveling direction of the intermediate transfer belt 12 is about half circumferential length of the intermediate transfer belt 12 or about several hundred millimeters which is more than half circumferential length of the intermediate transfer belt 12, and is usually longer than a distance from the secondary transfer position to the label position detection member. Therefore, it is necessary for the LED head 3Y to start exposure before the position of the label at which a toner image is actually transferred is detected.

In this way, the LED head 3Y starts exposure before the position of the label at which the toner image is transferred is detected. Therefore, the timing to start exposure is determined by estimation based on a detection result of a label position on a more downstream side, not based on a label to which a toner image is transferred.

For example, when a label on a downstream side as a reference is a first label and a label to which a toner image is transferred is an Nth label, and when an average label pitch is P, the position of the label to which the toner image is transferred is estimated to be at P×(N−1) on an upstream side from the reference label position, and the timing to start exposure is determined.

However, in such a method, when the difference between the average label pitch P and a label pitch P' obtained when an image is actually formed is not sufficiently small, misalignment of the image on label to which the toner image is actually transferred becomes large. For example, in a case of printing on a label roll having a label pitch such that N=5, when the difference between P and P' is 0.2 mm, the write position of the toner image deviates by an amount of 0.2×(5−1)=0.8 mm.

In view of such a problem, in the present embodiment, during the pre-feeding operation or during the print operation, the label pitch table is updated based on the measured value of the interval of the black marks measured using the reflection type write position detection sensor 36, a value close to the label pitch measured using the reflection type write position detection sensor 36 is always maintained, and an error in the write position of the leading toner image is minimized.

In the present embodiment, a case is described where the label pitch is detected by detecting the black marks using the reflection type write position detection sensor 36. However, as illustrated in FIGS. 6A-6C, it is also possible that the label sheet 20*b* in which a plurality of labels 46 are affixed at a predetermined interval on a continuous mount 47 (the label sheet 20*b* in which, between the labels 46, only the mount 47 exists and label leavings do not exists) is used, and a label pitch is detected using the transmission type write position detection sensor 33.

Further, it is also possible that a pre-printing sheet on which positions at which a toner image is to be transferred are determined in advance is used, black marks are detected using the reflection type write position detection sensor 36, and a toner image position pitch is detected. Such a pitch is one type of the interval of the present invention.

As described above, in the present embodiment, during the pre-feeding operation or during the print operation, the label pitch table is updated based on the measured value of the interval of the black marks measured using the reflection type write position detection sensor 36, and the timing to start forming the leading toner image is calculated based on the measured value of the interval of the black marks. Thereby, an effect is achieved that the error in the write position of the leading toner image can be minimized.

Further, the label pitch of the label pitch table is maintained for each environmental temperature and humidity. Thereby, an effect is achieved that even when the environmental humidity changes during a print operation, the error in the write position of the leading toner image can be minimized.

In the present embodiment, the image forming apparatus is described as a printer. However, the present invention is not limited to this. The image forming apparatus may also be a copying machine, a facsimile machine, a multifunction machine (MFP), and the like.

In the application, the label pitch average value LAV or any information that is useful to determine the interval that is between the developed images is available for an interval information stored in the interval information memory.

What is claimed is:

1. An image forming apparatus that forms developer images on a continuous medium, comprising:

an exposure part for forming an electrostatic latent image on an image carrier that has been charged;

a development part that forms a developer image by supplying a developer to the electrostatic latent image formed on the image carrier;

a primary transfer part that transfers the developer image formed on the image carrier onto an intermediate transfer body;

a carrying part that carries the continuous medium on which a plurality of labels are provided on a mount with interval;

a secondary transfer part that transfers the developer image formed on the intermediate transfer body onto the carried continuous medium at a secondary transfer position;

an interval detection part that is arranged on an upstream side of the secondary transfer part in a carrying direction of the continuous medium and detects an interval of positions to which the developer images are to be transferred on the labels of the continuous medium;

an interval information memory that stores the interval detected by the interval detection part as interval information; and a control part that controls timing for forming the electrostatic latent image on the image carrier based on the interval information stored in the interval information memory, causes the interval detection part to detect the interval, and updates the interval information of the interval information memory based on the detected interval, wherein based on the interval of the labels, the control part determines a timing of forming the electrostatic latent image to be formed on the image carrier by the exposure part so as to adjust the position for transferring the developer image on an N-th label, which is carried and reaches the secondary transfer part subsequently from the currently passing label.

2. The image forming apparatus according to claim 1, wherein the interval of the developer images is defined as a length on the intermediate transfer body, the length being determined from a leading edge of one developer image to a leading edge of the next developer image that follows the one developer image.

3. The image forming apparatus according to claim 1, wherein the interval of the developer images is defined as a length on the intermediate transfer body, the length being determined from a trailing edge of one developer image to a leading edge of the next developer image that follows the one developer image.

4. The image forming apparatus according to claim 1, wherein during an operation of feeding the continuous medium or during the operation of forming the developer image, the control part detects the interval using the interval detection part.

5. The image forming apparatus according to any one of claim 1, wherein the interval information memory stores the interval information in association with an image forming condition, and the control part obtains the image forming condition that corresponding to the continuous medium, and determines the timing of forming the developer images on the intermediate transfer body based on the interval information corresponding to the image forming condition.

6. The image forming apparatus according to claim 5, wherein the control part initializes the interval information with reference values for the image forming condition before feeding the continuous medium.

7. The image forming apparatus according to any one of claim 5, wherein the image forming condition include at least one of a medium type, a medium size, an environmental temperature and an environmental humidity.

8. The image forming apparatus according to any one of claim 5, further comprising:

a temperature detection part that detects an environmental temperature that is a temperature surrounding the image forming apparatus, wherein the control part stores the interval information in the interval information memory in association with the environmental temperature detected by the temperature detection part.

9. The image forming apparatus according to claim 5, further comprising:

a humidity detection part that detects an environmental humidity that is a humidity surrounding the image forming apparatus, wherein the control part stores the interval information in the interval information memory in association with the environmental humidity detected by the humidity detection part.

10. The image forming apparatus according to claim 1, wherein the interval detection part is a reflection type optical sensor.

11. The image forming apparatus according to claim 1, wherein the interval detection part is a transmission type optical sensor.

12. The image forming apparatus according to claim 1, wherein the continuous medium is a label roll in which a plurality of labels are affixed on the mount and each of the labels are separated with the interval in the carrying direction.

13. The image forming apparatus according to claim 1, wherein the continuous medium is a pre-printing sheet on which the positions to which the developer images are transferred are marked.

14. The image forming apparatus according to claim 1, wherein the following equation is satisfied:

$$LHT>LST,$$

where LHT is a distance from a position at which the electrostatic latent image is formed on the image carrier to the secondary transfer position along a carrying path on which the electrostatic latent image and the developer image are carried, and LST is a distance from the interval detection part to the secondary transfer position.

15. The image forming apparatus according to claim 14, wherein the interval information memory stores a reference interval LO as an initial value, and the value N is determined from $$N=\text{Roundup}((LHT-LST)/LO)+1,$$

where Roundup is a function to round up after the decimal point, and the value N is a number.

16. The image forming apparatus according to claim 15, wherein a timing for starting exposure by the exposure part at the position to form the developer image for the N-th label is determined based on a distance LF, which is a distance from a position of the detection of an end part of a first label by the interval detection part to a position at which the electrostatic latent image is formed on the image carrier by the exposure part, and the distance LF is determined from the following equation:

$$LF=(N-1)\times LO-(LHT-LST).$$

17. The image forming apparatus according to claim 15, wherein the reference interval LO stored in the interval information memory is rewritten after a pre-feeding operation before transferring the developer image on labels.

18. The image forming apparatus according to claim 17, wherein the interval information memory is rewritten with an average value of the interval information detected by the interval detection part when the plurality of labels pass through the secondary transfer part.

* * * * *